US011477570B2

(12) United States Patent
Pelissier et al.

(10) Patent No.: US 11,477,570 B2
(45) Date of Patent: Oct. 18, 2022

(54) CONTROLLING AUDIO OF AN INFORMATION HANDLING SYSTEM

(71) Applicant: Dell Products L.P., Round Rock, TX (US)

(72) Inventors: Gerald Rene Pelissier, Mendham, NJ (US); Yagiz Can Yildiz, Austin, TX (US); Hsufeng Lee, Taipei (TW)

(73) Assignee: Dell Products L.P., Round Rock, TX (US)

( * ) Notice: Subject to any disclaimer, the term of this patent is extended or adjusted under 35 U.S.C. 154(b) by 36 days.

(21) Appl. No.: 17/167,858

(22) Filed: Feb. 4, 2021

(65) Prior Publication Data

US 2022/0248134 A1 Aug. 4, 2022

(51) Int. Cl.

| | |
|---|---|
| ***H04R 3/00*** | (2006.01) |
| ***H04S 7/00*** | (2006.01) |
| ***G10L 21/0216*** | (2013.01) |
| ***H04R 5/04*** | (2006.01) |

(52) U.S. Cl.

CPC ..... *H04R 3/005* (2013.01); *G10L 21/0216* (2013.01); *H04R 5/04* (2013.01); *H04S 7/302* (2013.01); *G10L 2021/02166* (2013.01)

(58) Field of Classification Search

CPC ..... H04R 5/02; H04R 3/12; H04R 2420/07; H04R 2227/005; H04S 2420/01; H04S 7/30

USPC ..... 381/310, 300; 700/94

See application file for complete search history.

(56) References Cited

U.S. PATENT DOCUMENTS

| | | | | |
|---|---|---|---|---|
| 11,316,966 | B2 * | 4/2022 | Coffman | G06F 3/0414 |
| 2016/0005435 | A1 * | 1/2016 | Campbell | H04N 5/23238 386/240 |
| 2016/0327950 | A1 * | 11/2016 | Bachrach | G06F 3/04883 |
| 2018/0343534 | A1 * | 11/2018 | Norris | G06V 10/17 |
| 2019/0313054 | A1 * | 10/2019 | Harrison | G06Q 10/063114 |
| 2020/0382335 | A1 * | 12/2020 | Trim | H04L 12/2829 |
| 2022/0044016 | A1 * | 2/2022 | Pan | G06V 20/35 |

* cited by examiner

*Primary Examiner* — Alexander Krzystan

(74) *Attorney, Agent, or Firm* — McDermott Will & Emery

(57) ABSTRACT

Controlling audio of an information handling system (IHS), including calculating a first configuration of speakers of a IHS based on a first location of the user of the IHS with respect to the IHS, the first configuration including a first frequency associated with a first speaker, and a second frequency associated with a second speaker; identifying a change in location of the user from the first location with respect to the IHS, and in response: determining whether the user is within a field of view of a camera of the IHS, and in response, determining a second location of a mobile computing device associated with the user with respect to the IHS; calculating a second configuration the speakers of the IHS based on the second location of the user, the second configuration including the second frequency associated with the first speaker, and the first frequency associated with the second speaker.

14 Claims, 10 Drawing Sheets

CONTROLLING AUDIO OF AN INFORMATION HANDLING SYSTEM

BACKGROUND

Field of the Disclosure

The disclosure relates generally to an information handling system, and in particular, controlling audio of an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Modern & emerging devices such as large form factor foldable PCUs (personal computing units) need to provide appropriate audio and voice user experience for the multiple use cases by a user.

SUMMARY

Innovative aspects of the subject matter described in this specification may be embodied in a method of controlling audio of an information handling system, the method comprising: identifying a first location of a user of the information handling system with respect to the information handling system; calculating a first configuration of speakers of an information handling system based on the first location of the user, the first configuration including a first frequency and a first power associated with a first speaker, and a second frequency and a second power associated with a second speaker; identifying a change in location of the user from the first location with respect to the information handling system, and in response: determining whether the user is within a field of view of a camera of the information handling system; in response to determining that the user is not within the field of view of the camera of the information handling system, determining a second location of a mobile computing device associated with the user with respect to the information handling system; and calculating a second configuration the speakers of the information handling system based on the second location of the user, the second configuration including the second frequency and a third power associated with the first speaker, and the first frequency and a fourth power associated with the second speaker.

Other embodiments of these aspects include corresponding systems, apparatus, and computer programs, configured to perform the actions of the methods, encoded on computer storage devices.

These and other embodiments may each optionally include one or more of the following features. For instance, calculating a first configuration of a microphone array of the information handling system based on the first location of the user, the first configuration of the microphone array including selecting a first subset of microphones of the microphone array to microphone beamform based on the first location of the user, wherein in response to identifying the change in location of the user further comprises: calculating a second configuration of the microphone array based on the second location of the user, the second configuration of the microphone array including selecting a second subset of microphones of the microphone array to microphone beamform based on the second location of the user. In response to identifying the change in location of the user further comprises: calculating a distance between the second location of the user and the information handling system; comparing the distance to a first threshold and a second threshold; determining, based on the comparing, that the distance is greater than the first threshold and less than the second threshold; and in response to the distance being greater than the first threshold and less that the second threshold, increasing a gain of the second subset of microphones of the microphone array. In response to identifying the change in location of the user further comprises: determining, based on the comparing, that the distance is greater than the second threshold; and in response to the distance being greater than the second threshold, adjusting a power state of the speakers and the microphone array to an off-power state. Determining that the user is within the field of view of the camera of the information handling system, and in response: determining a third location of the user with respect to the information handling system; calculating a third configuration the speakers of the information handling system based on the third location of the user, the third configuration including the second frequency and a fifth power associated with the first speaker, and the first frequency and a sixth power associated with the second speaker. The third power of the first speaker is greater than the first power of the first speaker, and the fourth power of the second speaker is greater than the second power of the second speaker. The fifth power of the first speaker is greater than the first power of the first speaker and less than the third power of the first speaker; and the sixth power of the second speaker is greater than the second power of the second speaker and less than the fourth power of the second speaker. The second frequency is greater than the first frequency.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
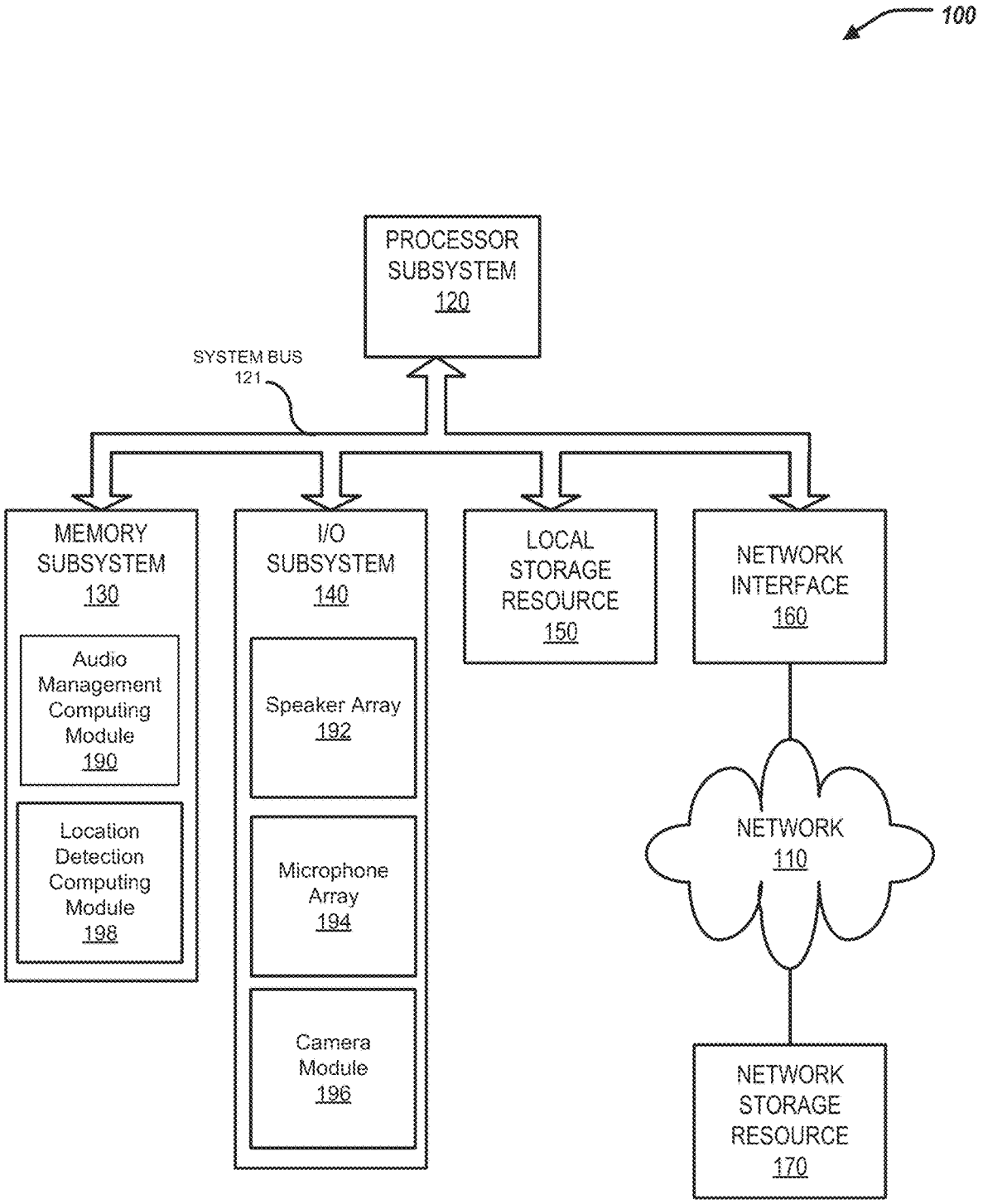
FIG. 1 is a block diagram of selected elements of an embodiment of an information handling system.

This disclosure discusses methods and systems for controlling audio of an information handling system. In short, an audio management computing module can configure a speaker array and/or a microphone array based on a location of a user of the information handling system. Specifically, a location detection computing module can identify the location of the user of the information handling system (e.g., in coordination with a camera module and/or a mobile computing device of the user). The audio management computing module can modulate i) a volume/power/magnitude of the speaker array and ii) a sound frequency of the speaker array based on the distance. Furthermore, the audio management computing module can apply microphone beamforming to the microphone array based on the location of the user. As the user moves about the information handling system, the audio management computing module can adjust the configuration of the speaker array and/or the microphone array to optimize the experience for the user, described further herein.

Specifically, this disclosure discusses a system and a method for controlling audio of an information handling system, the method comprising: identifying a first location of a user of the information handling system with respect to the information handling system; calculating a first configuration of speakers of an information handling system based on the first location of the user, the first configuration including a first frequency and a first power associated with a first speaker, and a second frequency and a second power associated with a second speaker; identifying a change in location of the user from the first location with respect to the information handling system, and in response: determining whether the user is within a field of view of a camera of the information handling system; in response to determining that the user is not within the field of view of the camera of the information handling system, determining a second location of a mobile computing device associated with the user with respect to the information handling system; and calculating a second configuration the speakers of the information handling system based on the second location of the user, the second configuration including the second frequency and a third power associated with the first speaker, and the first frequency and a fourth power associated with the second speaker.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-10 wherein like numbers are used to indicate like and corresponding parts.

Turning now to the drawings, FIG. 1 illustrates a block diagram depicting selected elements of an information handling system 100 in accordance with some embodiments of the present disclosure. In various embodiments, information handling system 100 may represent different types of portable information handling systems, such as, display devices, head mounted displays, head mount display systems, smart phones, tablet computers, notebook computers, media players, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems. Components of information handling system 100 may include, but are not limited to, a processor subsystem 120, which may comprise one or more processors, and system bus 121 that communicatively couples various system components to processor subsystem 120 including, for example, a memory subsystem 130, an I/O subsystem 140, a local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

As depicted in FIG. 1, processor subsystem 120 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 120 may interpret and/or execute program instructions and/or process data stored locally (e.g., in memory subsystem 130 and/or another component of information handling system). In the same or alternative embodiments, processor subsystem 120 may interpret and/or execute program instructions and/or process data stored remotely (e.g., in network storage resource 170).

Also in FIG. 1, memory subsystem 130 may comprise a system, device, or apparatus operable to retain and/or retrieve program instructions and/or data for a period of time (e.g., computer-readable media). Memory subsystem 130 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In information handling system 100, I/O subsystem 140 may comprise a system, device, or apparatus generally operable to receive and/or transmit data to/from/within information handling system 100. I/O subsystem 140 may represent, for example, a variety of communication interfaces, graphics interfaces, video interfaces, user input interfaces, and/or peripheral interfaces. In various embodiments, I/O subsystem 140 may be used to support various peripheral devices, such as a touch panel, a display adapter, a keyboard, an accelerometer, a touch pad, a gyroscope, an IR sensor, a microphone, a sensor, or a camera, or another type of peripheral device. In some examples, the I/O subsystem 140 can include a speaker array 192, a microphone array 194, and a camera module 196.

Local storage resource 150 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data. Likewise, the network storage resource may comprise computer-readable media (e.g., hard disk drive, floppy disk drive, CD-ROM, and/or other type of rotating storage media, flash memory, EEPROM, and/or other type of solid state storage media) and may be generally operable to store instructions and/or data.

In FIG. 1, network interface 160 may be a suitable system, apparatus, or device operable to serve as an interface between information handling system 100 and a network 110. Network interface 160 may enable information handling system 100 to communicate over network 110 using a suitable transmission protocol and/or standard, including, but not limited to, transmission protocols and/or standards enumerated below with respect to the discussion of network 110. In some embodiments, network interface 160 may be communicatively coupled via network 110 to a network storage resource 170. Network 110 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 160 may enable wired and/or wireless communications (e.g., NFC or Bluetooth) to and/or from information handling system 100.

In particular embodiments, network 110 may include one or more routers for routing data between client information handling systems 100 and server information handling systems 100. A device (e.g., a client information handling system 100 or a server information handling system 100) on network 110 may be addressed by a corresponding network address including, for example, an Internet protocol (IP) address, an Internet name, a Windows Internet name service (WINS) name, a domain name or other system name. In particular embodiments, network 110 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

Network 110 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 110 and its various components may be implemented using hardware, software, or any combination thereof.

The information handling system 100 can also include an audio management computing module 190. The audio management computing module 190 can be included by the memory subsystem 130. The audio management computing module 190 can include a computer-executable program (software). The audio management computing module 190 can be executed by the processor subsystem 120.

The information handling system 100 can also include a location detection computing module 198. The location detection computing module 198 can be included by the memory subsystem 130. The location detection computing module 198 can include a computer-executable program (software). The location detection computing module 198 can be executed by the processor subsystem 120.

In short, the audio management computing module 190 can configure the speaker array 192 and/or the microphone array 194 based on a location of a user of the information handling system 100. Specifically, the location detection computing module 198 can identify the location of the user of the information handling system 202 (e.g., in coordination with the camera module 196 and/or a mobile computing device of the user). The audio management computing module 190 can modulate i) a volume/power/magnitude of the speaker array 192 and ii) a sound frequency of the speaker array 192 based on the distance. Furthermore, the audio management computing module 190 can apply microphone beamforming to the microphone array 194 based on the location of the user. As the user moves about the information handling system 100, the audio management computing module 190 can adjust the configuration of the speaker array 192 and/or the microphone array 194 to optimize the experience for the user, described further herein.

Figure 2:
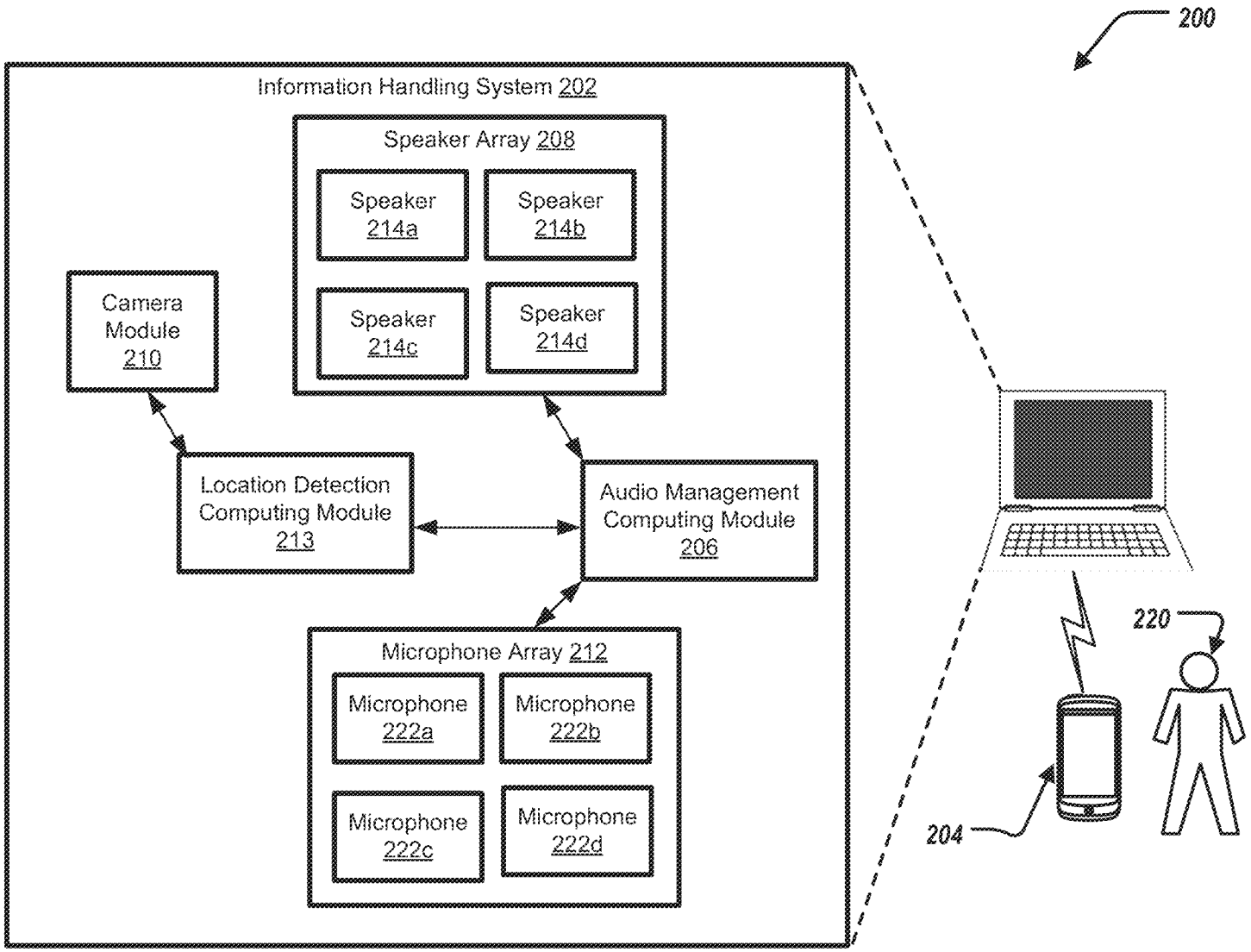
FIG. 2 illustrates a block diagram of an information handling system for controlling audio of the information handling system.

Turning to FIG. 2, FIG. 2 illustrates an environment 200 including an information handling system 202 and a mobile computing device 204. The information handling system 202 can include an audio management computing module 206, a speaker array 208, a camera module 210, a microphone array 212, and a location detection computing module 213. In some examples, the information handling system 202 is similar to, or includes, the information handling system 100 of FIG. 1. In some examples, the audio management computing module 206 is the same, or substantially the same, as the audio management computing module 190 of FIG. 1. In some examples, the speaker array 208 is the same, or substantially the same, as the speaker array 192 of FIG. 1. In some examples, the camera module 210 is the same, or substantially the same, as the camera module 196 of FIG. 1. In some examples, the microphone array 212 is the same, or substantially the same, as the microphone array of 194 of FIG. 1. The environment 200 can include a physical environment, a computing environment, or both.

In some examples, the information handling system 202 can be a desktop computing system or a mobile computing system such as a laptop computing system, a smart phone, a tablet computing device, a phablet computing device, or similar. In some examples, when the information handling system 202 includes a mobile computing system, the mobile computing system can be a foldable computing system or a large form factor foldable personal computing unit (PCU). The information handling system 202 can be positioned in various different configurations and postures. For example, the information handling system 202 can be in a table-top posture mode, a book posture mode, and/or a tent posture mode.

Figure 4:
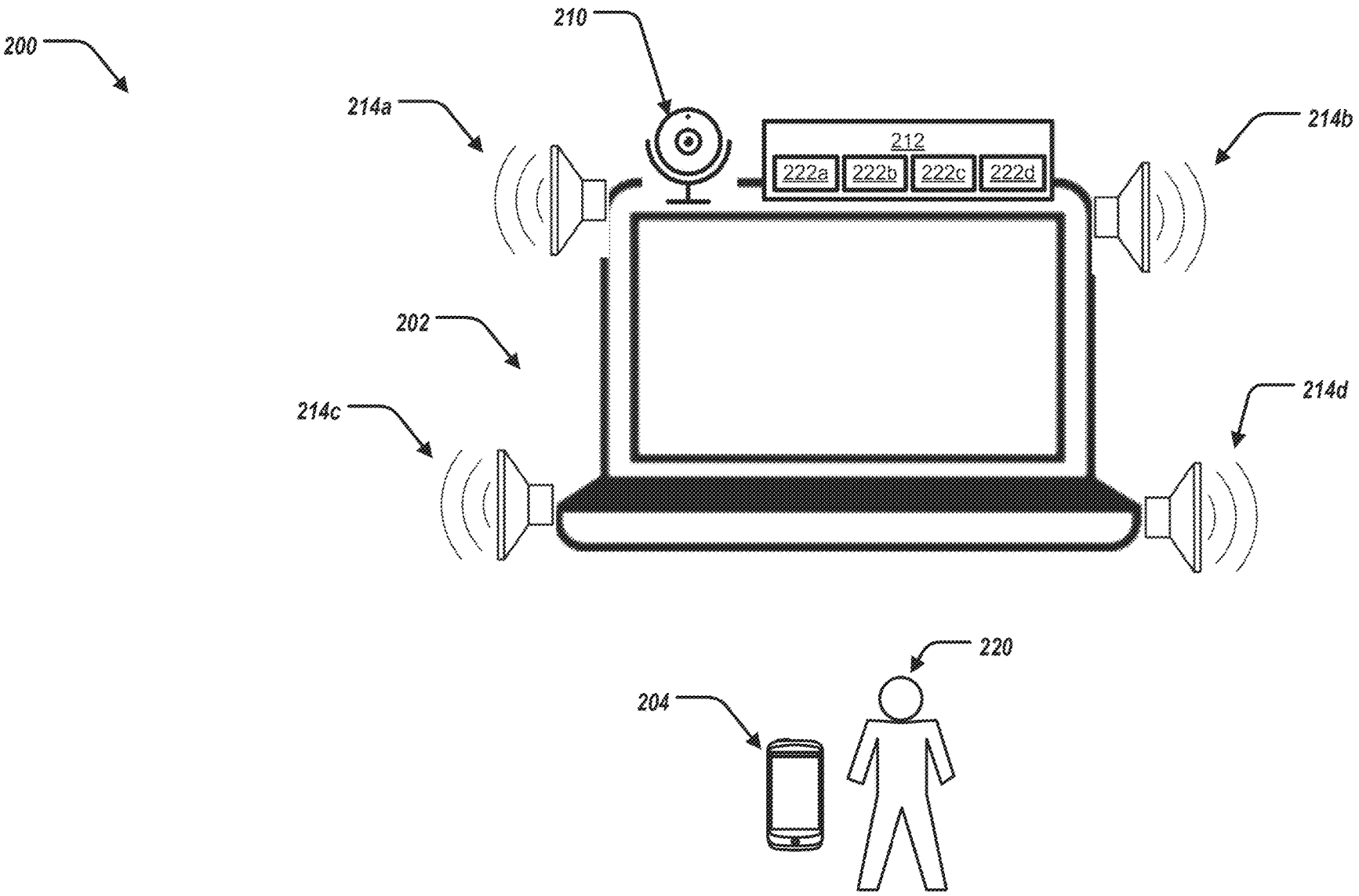
FIGS. 4-8 illustrate respective configurations of a microphone array and a speaker array of the information handling system.

The speaker array 208 can include a plurality of speakers 214*a*, 214*b*, 214*c*, 214*d* (collectively referred to as speakers 214); however, the speaker array 208 can include any number of speakers. Each of the speakers 214 can be full-audio frequency speakers. That is, each of the speakers 214 is capable of producing i) high frequency sounds (e.g., 2 kHz-20 kHz) (commonly referred to as "tweeters") and ii) low frequency sounds (e.g., 20-200 Hz) (commonly referred to as "subwoofers"). The speakers 214 are able to dynamically switch frequency (e.g., from high frequency to low frequency and vice versa) based on a location of a user 220 associated with the information handling system 202 (using/engaging with the information handling system 202), described further herein. Furthermore, the speakers 214 are able to dynamically switch channel (e.g., from right channel to left channel and vice versa) based on the location of the user 220, described further herein. In some examples, the speakers 214 are physically located at one or more sides (edges) of the information handling system 202, as shown in FIG. 4. However, the speakers 214 can be physically positioned anywhere along the information handling system 202, depending on the application desired.

The microphone array 212 can include a plurality of microphones 222*a*, 222*b*, 222*c*, 222*d* (collectively referred to as microphones 222); however, the microphone array 212 can include any number of microphones. Differing subsets of the microphones 222 can be selected for use by the information handling system 202 in furtherance of detecting sounds (e.g., by the user 220) based on the location of the user 220 to beamform the microphone array 212 to the user, described further herein. In some examples, the microphones 222 are physically located at a particular surface of the information handling system 202, as shown in FIG. 4. However, the microphones 222 can be physically positioned anywhere about the information handling system 202, depending on the application desired.

The camera module 210 can include an integrated camera (webcam) or an external camera to the information handling system 202. The camera module 210 can be associated with a field of view—e.g., a portion of the (physical) environment 200 that is visible to the camera module 210 (through the camera module 210) at a particular position and orientation of the camera module 210 in the environment 200 and with respect to the information handling system 202. In some examples, the camera module 210 can include a RGB camera, or an IR camera. In some examples, the camera module 210 is physically located at a particular surface of the information handling system 202, as shown in FIG. 4. However, the camera module 210 can be physically positioned anywhere about the information handling system 202, depending on the application desired.

The audio management computing module 206 can be in communication with the speaker array 208, the camera module 210, the microphone array 212, and the location detection computing module 213. The information handling system 202 can be in communication with the mobile computing device 204. The location detection computing module 213 can be in communication with the mobile computing device 204.

Figure 3:
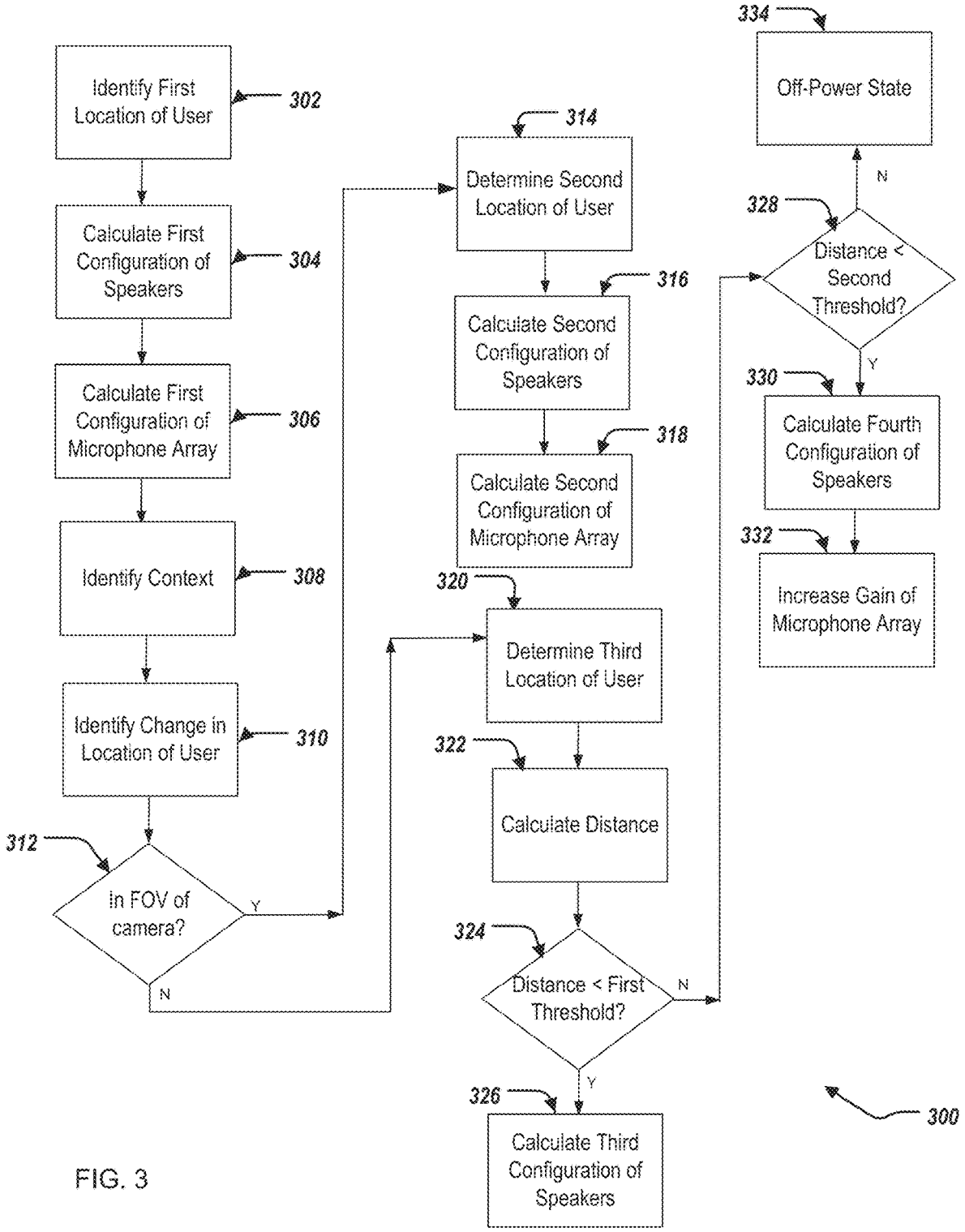
FIG. 3 illustrates a method for controlling audio of the information handling system.

FIG. 3 illustrates a flowchart depicting selected elements of an embodiment of a method 300 for controlling audio of an information handling system. The method 300 may be performed by the information handling system 100, the information handling system 202, the audio management computing module 206, and/or the location detection computing module 213, and with reference to FIGS. 1-2 and 4-10. It is noted that certain operations described in method 300 may be optional or may be rearranged in different embodiments The location detection computing module 213 can identify a first location of the user 220 with respect to the information handling system 202, at 302. Referring to FIG. 4, in some examples, the camera module 210 can detect the first location of the user 220. That is, the user 220 can be within the field of view of the camera module 210 such that the camera module 210 can provide data indicating such to the location detection computing module 213. The data can include an image (RGB, IR, or other) of the user 220 with respect to the environment 200. The location detection computing module 213 can process the data from the camera module 210 to identify the first location of the user 220 with respect to the information handling system 202. In some examples, the camera module 210 can transmit the data indicating the first location of the user 220 automatically (e.g., every 1 second, 1 minute), or in response to a request from the location detection computing module 213.

In some examples, the location detection computing module 213 can determine the first location of the user 220 based on a location of the mobile computing device 204 with respect to the information handling system 202. That is, the mobile computing device 204 can provide a location signal to the location detection computing module 213. The location detection computing module 213 can process the location signal to determine the location of the mobile computing device 204 with respect to the information handling system 202, and thus, the first location of the user 220 (as the mobile computing device 204 is associated with the user 220). That is, the location of the user 220 can be similar to, or substantially the same as, the location of the mobile computing device 204 (the location of the user 220 with respect to the information handling system 202 is equated with the location of the mobile computing device 204 with respect to the information handling system 202). Specifically, based on an intensity of the location signal and/or a time to transmit the location signal from the mobile computing device 204 and to receive the location signal at the location detection computing module 213, the location detection computing module 213 can determine the location of the mobile computing device 204 with respect to the information handling system 202. In some examples, the location signal is a Wi-Fi signal, a Bluetooth signal, or an ultra-wide band (UWB) signal.

The location detection computing module 213 can transmit data indicating the first location of the user 220 to the audio management computing module 206.

The audio management computing module 206 calculates a first configuration of the speakers 214 based on the first location of the user 230, at 304. A configuration of the speakers 214 can include a frequency range of each respective speaker, a channel of each respective speaker, and a power (or volume level) of each respective speaker. Referring to FIG. 4, specifically, the first configuration of the speakers 214 can include the speaker 214*a* associated with a High frequency (tweeter), a left channel, and a respective power; the speaker 214*b* associated with a high frequency (tweeter), right channel, and a respective power; the speaker 214*c* associated with a low frequency (subwoofer), left channel, and a respective power; and the speaker 214*d* associated with a low frequency (subwoofer), Right channel, and a respective power. That is, the first configuration of the speakers 214—frequency of each speaker 214, channel of each speaker 214, and power (or volume level) of each speaker 214—is set (or configured) based on the first location of the user 230. That is, the first configuration of the speakers 214 can be based on the location of the user 220 to optimize the "experience" of the user 220—optimize the sound quality, sounds levels, or other sound metrics of the speakers 214 for the first location of the user 220.

The audio management computing module 206 can further calculate a first configuration of the microphone array 212 based on the first location of the user 220, at 306. A configuration of the microphone array 212 can include selecting a subset of the microphones 222 to microphone beamform based on the first location of the user 220. Referring to FIG. 4, specifically, the first configuration of the microphone array 212 can include selecting a first subset of the microphones 222—e.g., the microphones 222*b*, 222*c* that are closest to the user 220. However, in some examples, any subset of the microphones 222 can be selected for the first subset of microphones 222. The audio management computing module 206 can apply a beamforming algorithm to the first subset of microphones 222 (e.g., upon detection of speech from the user 220).

The audio management computing module 206 can identify a context of the user 220 with respect to the information handling system 202, and a context of the information handling system 202, at 308. The context of the information handling system 202 can include a location of the information handling system 202. For example, the location of the information handling system 202 can include the type of environment 200—e.g., a home environment, or a work environment. The context of the information handling system 202 can include a time, and devices proximate to the information handling system (e.g., the mobile computing device 204).

The location detection computing module 213 can identify a change in the location of the user 220 from the first location with respect to the information handling system 202, at 310. In particular, the location of the user 220 with respect to the information handling system 202 is not consistent—the user 220 moves about the environment 200. For example, depending on the posture of the information handling system 202 (e.g., table-top posture mode, book posture mode, tent posture mode) and how the user 220 interacts with/uses the information handing system 202, the user 220 can change his/her location from the first location with respect to the information handling system 202. Furthermore, when detecting the change in location of the user 220 with respect to the information handling system 202, the location detection computing module 213 can further determine that a location of the information handling system 202 has not changed. Specifically, the information handling system 202 can include an inertia sensor (not shown) (or gyroscope) and a hinge angle sensor (not shown) (defined between bodies of the information handling system 202). The location detection computing module 213 can receive signals form the inertia sensor and the hinge angle sensor indicating zero (or little) movement, and thus, no location change of the information handling system 202.

Specifically, identifying the change in the location of the user 220 can include, and further, in response to such change in location of the user 220, the location detection computing module 213 can determine whether the user 220 is within the field of view of the camera module 210, at 312. In particular, the location detection computing module 213 can receive a signal from the camera module 210 indicating that the user 220 is within the field of view of the camera module 210.

Figure 5:
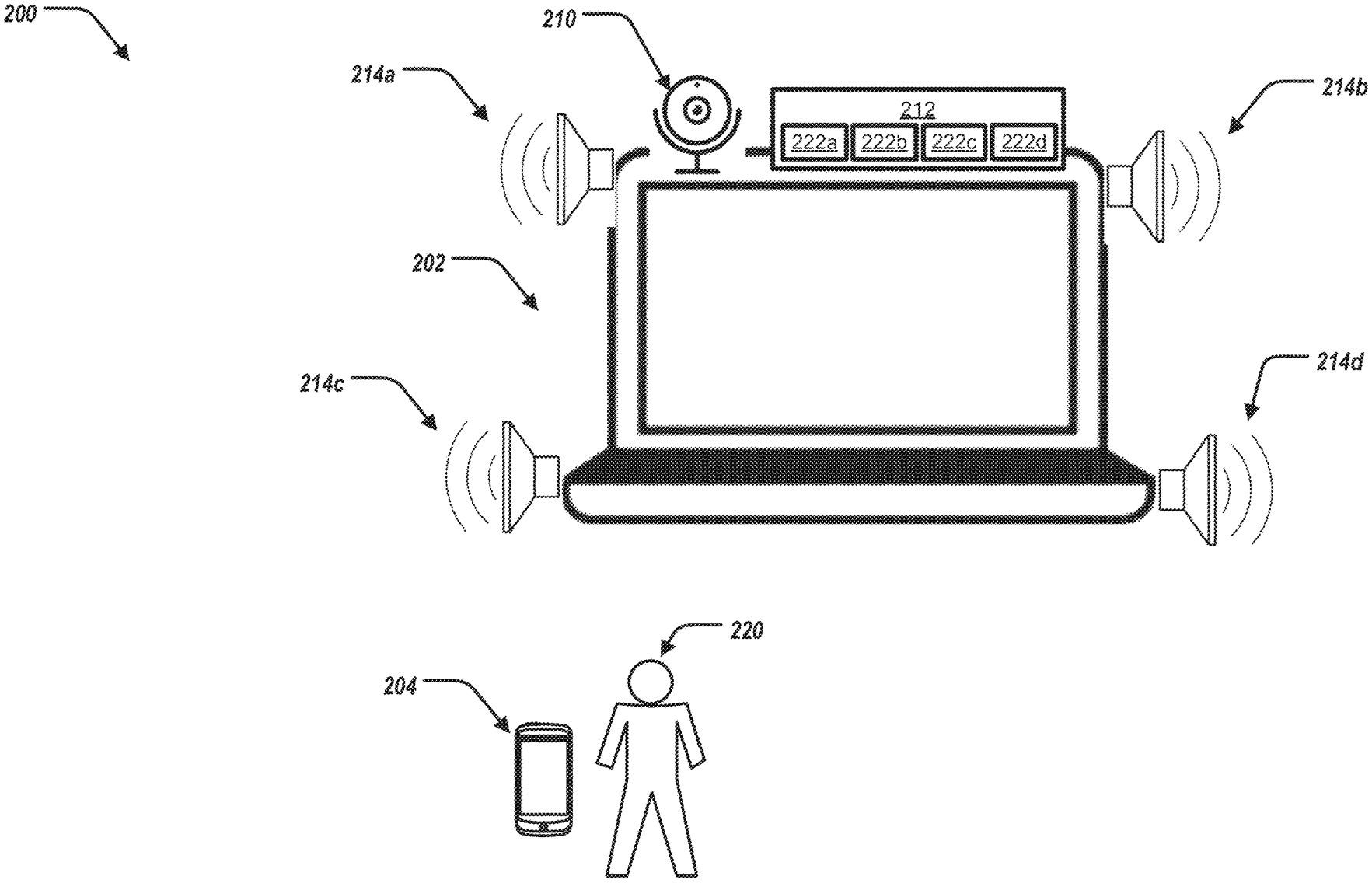

The location detection computing module 213 can determine that the user 220 is within the field of view of the camera module 210, as shown in FIG. 5. In response to determining that the user 220 is within the field of view of the camera module 210, the location detection computing module 213 determines a second location of the user 220 with respect to the information handling system 202, at 314 (e.g., within 1 meter of the information handling system 202). The location detection computing module 213 can provide the data indicating the second location of the user 220 to the audio management computing module 206. The audio management computing module 206 can calculate a second configuration of the speakers 214 based on the second location of the user 220, at 316. Specifically, the second configuration of the speakers 214 can include the speaker 214*a* associated with a low frequency (subwoofer), a left channel, and a respective power; the speaker 214*b* associated with a high frequency (tweeter), left channel, and a respective power; the speaker 214*c* associated with a low frequency (subwoofer), Right channel, and a respective power; and the speaker 214*d* associated with a high frequency (tweeter), right channel, and a respective power. That is, the second configuration of the speakers 214—frequency of each speaker 214, channel of each speaker 214, and power (or volume level) of each speaker 214—is set (or configured) based on the second location of the user 230. That is, the second configuration of the speakers 214 can be based on the second location of the user 220 to optimize the "experience" of the user 220—optimize the sound quality, sound levels, or other sound metric of the speakers 214 for the second location of the user 220. In some examples, the second configuration of the speakers 214 is further based on the context of the user 220 with respect to the information handling system 202, and/or the context of the information handling system 202.

Further in response to identifying the change in location of the user 220, the audio management computing module 206 can calculate a second configuration of the microphone array 212 based on the second location of the user 220, at 318. Referring to FIG. 5, specifically, the second configuration of the microphone array 212 can include selecting a second subset of the microphones 222—e.g., the microphones 222*a*, 222*b*, 222*c*, that are closest to the user 220. However, in some examples, any number of the microphones 222 can be selected for the second subset of microphones 222. The audio management computing module 206 can apply a beamforming algorithm to the second subset of microphones 222 (e.g., upon detection of speech from the user 220).

The location detection computing module 213 can determine that the user 220 is not within the field of view of the camera module 210 (at 312). In particular, the location detection computing module 213 can receive a signal from the camera module 210 indicating that the user 220 is not within the field of view of the camera module 210 (or not receive a signal from the camera module 210 indicating that the user 220 is within the field of view of the camera module 210). In response to determining that the user 220 is not within the field of view of the camera module 210, the location detection computing module 213 determines a third location of the user 220 with respect to the information handling system 202, at 320. Specifically, the location detection computing module 213 can determine the third location of the user 220 based on a location of the mobile computing device 204 with respect to the information handling system 202 (e.g., within 1-3 meters of the information handling system 202). That is, the mobile computing device 204 can provide a location signal to the location detection computing module 213. The location detection computing module 213 can process the location signal to determine the location of the mobile computing device 204 with respect to the information handling system 202, and thus, the third location of the user 220 (as the mobile computing device 204 is associated with the user 220).

The location detection computing module 213 can provide the data indicating the third location of the user 220 to the audio management computing module 206. The audio management computing module 206 can then calculate a distance between the third location of the user 220 and the information handling system 202, at 322. The audio management computing module 206 can determine whether the distance between the third location of the user 220 and the information handling system 202 is less than a first threshold, at 324. For example, the first threshold is three meters.

Figure 6:
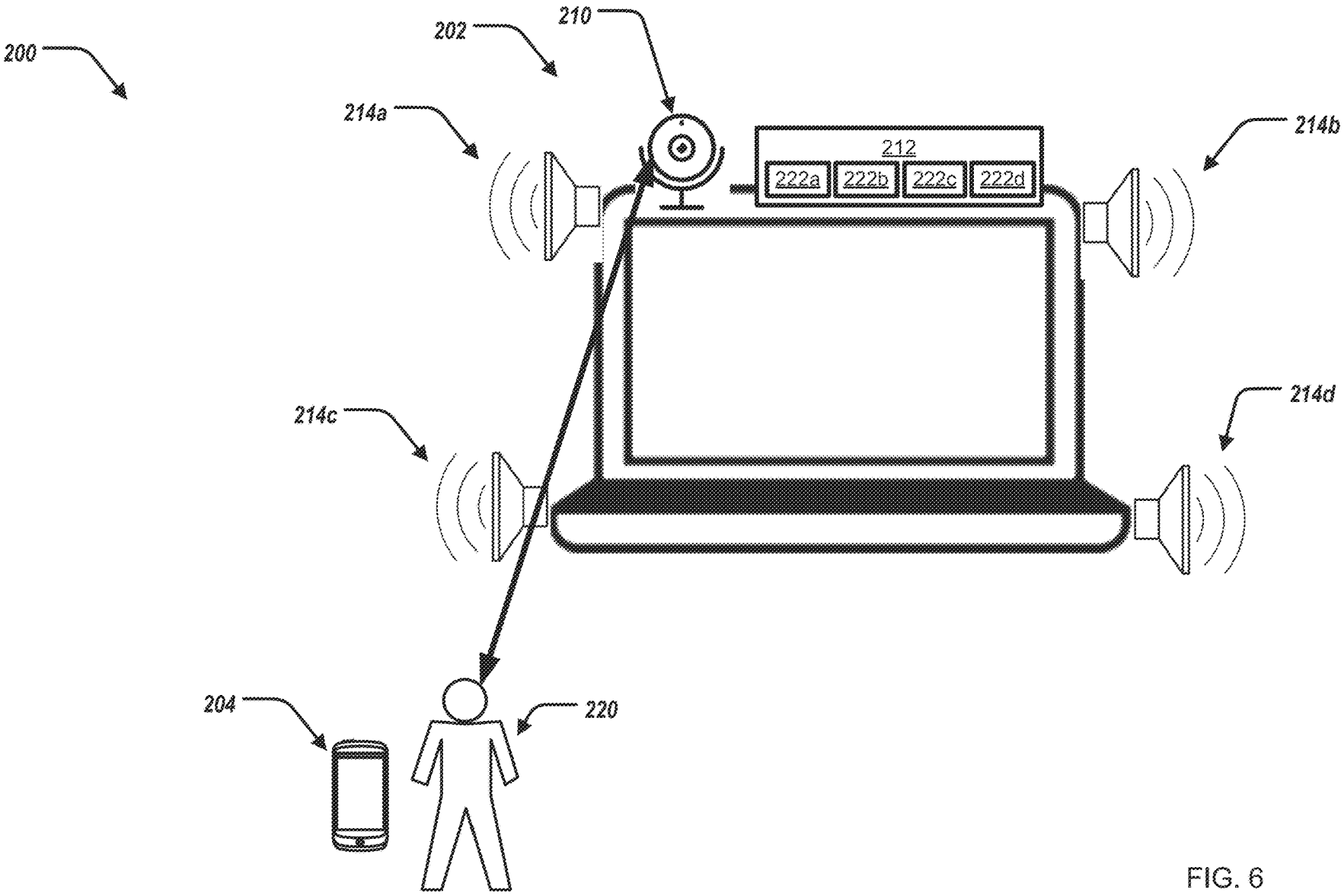

When the audio management computing module 206 determines that the distance between the third location of the user 220 and the information handling system 202 is less than the first threshold, the audio management computing module 206 can calculate a third configuration of the speakers 214 based on the third location of the user 220, at 326, as shown in FIG. 6. Specifically, the third configuration of the speakers 214 can include the speaker 214*a* associated with a low frequency (subwoofer), a left channel, and a respective power; the speaker 214*b* associated with a high frequency (tweeter), left channel, and a respective power; the speaker 214*c* associated with a low frequency (subwoofer), right channel, and a respective power; and the speaker 214*d* associated with a high frequency (tweeter), right channel, and a respective power. That is, the third configuration of the speakers 214—frequency of each speaker 214, channel of each speaker 214, and power (or volume level) of each speaker 214—is set (or configured) based on the third location of the user 230. That is, the third configuration of the speakers 214 can be based on the third location of the user 220 to optimize the "experience" of the user 220—optimize the sound quality, sounds levels, or other sound metric of the speakers 214 for the third location of the user 220. In some examples, the third configuration of the speakers 214 is further based on the context of the user 220 with respect to the information handling system 202, and/or the context of the information handling system 202.

Figure 7:
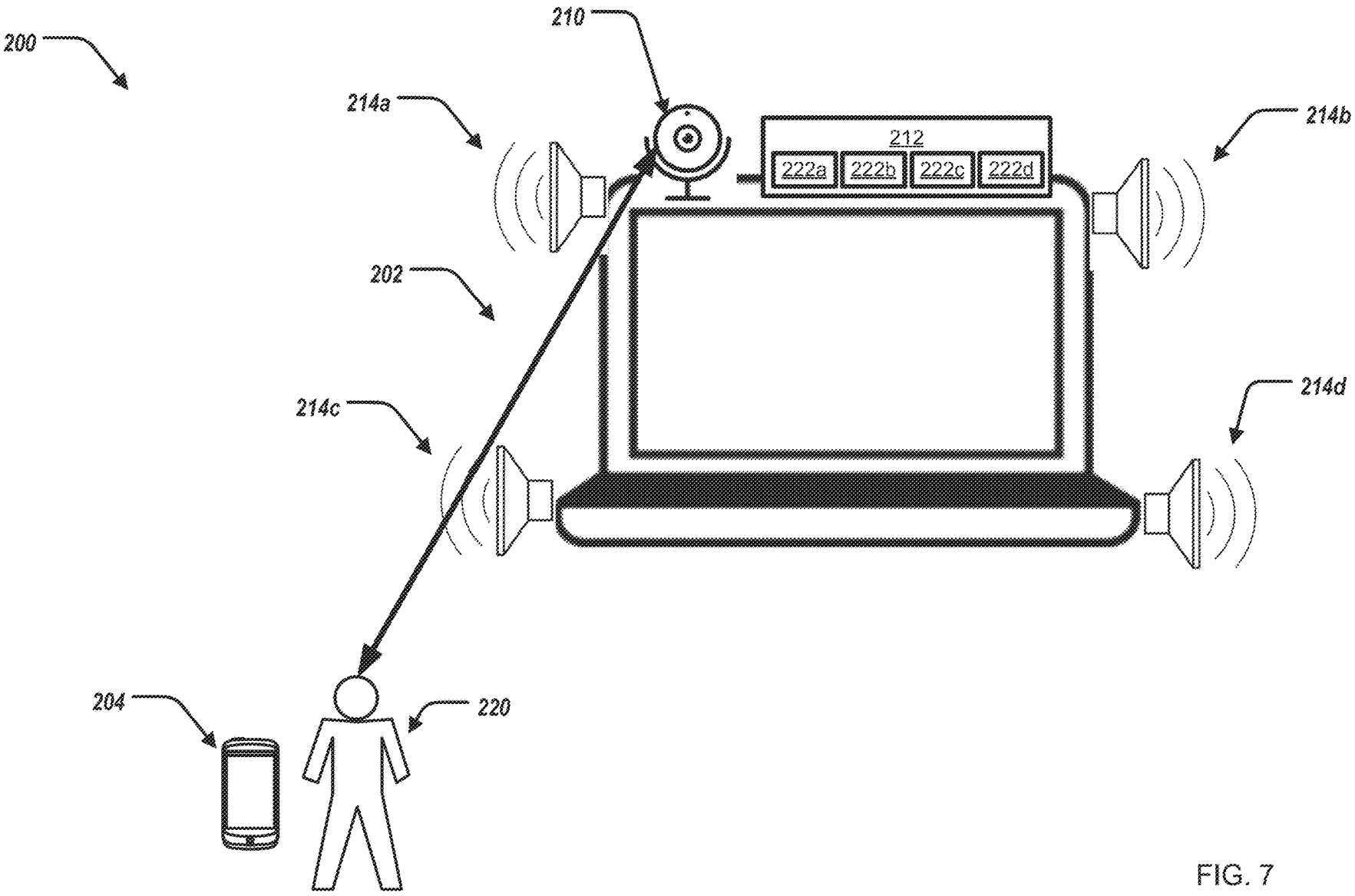

When the audio management computing module 206 determines that the distance between the third location of the user 220 and the information handling system 202 is greater than the first threshold, the audio management computing module 206 determines whether the distance between the third location of the user 220 and the information handling system 202 is less than a second threshold (and greater than the first threshold), at 328. When the audio management computing module 206 determines that the distance between the third location of the user 220 and the information handling system 202 is less than the second threshold (and greater than the first threshold), the audio management computing module 206 can calculate a fourth configuration of the speakers 214 based on the third location of the user 220, at 330, as shown in FIG. 7. Specifically, the fourth configuration of the speakers 214 can include the speaker 214*a* associated with a low frequency (subwoofer), a left channel, and a respective power; the speaker 214*b* associated with a high frequency (tweeter), left channel, and a respective power; the speaker 214*c* associated with a low frequency (subwoofer), right channel, and a respective power; and the speaker 214*d* associated with a high frequency (tweeter), right channel, and a respective power. That is, the fourth configuration of the speakers 214—frequency of each speaker 214, channel of each speaker 214, and power (or volume level) of each speaker 214—is set (or configured) based on the third location of the user 230. That is, the fourth configuration of the speakers 214 can be based on the third location of the user 220 to optimize the "experience" of the user 220—optimize the sound quality, sound levels, or other sound metric of the speakers 214 for the third location of the user 220. In some examples, the fourth configuration of the speakers 214 is further based on the context of the user 220 with respect to the information handling system 202, and/or the context of the information handling system 202.

Additionally, when the audio management computing module 206 determines that the distance between the third location of the user 220 and the information handling system 202 is less than the second threshold (and greater than the first threshold), the audio management computing module 206 can increase a gain of the second subset of microphones 222, at 332. That is, as the user 220 moves further from the information handling system 202 (e.g., between three and five meters), the gain of the microphones 222 is increased for increase quality of sound reception.

Figure 8:
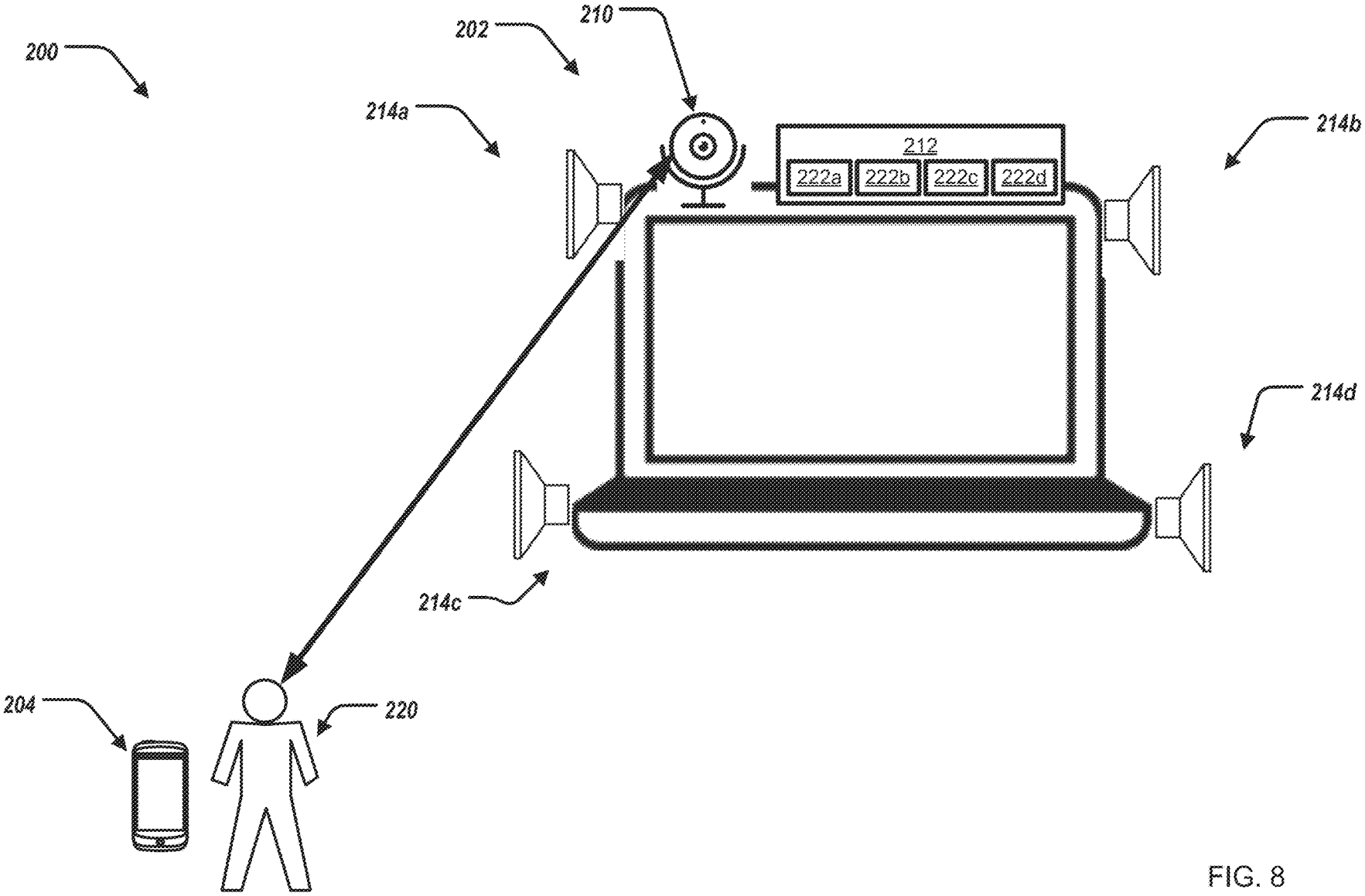

When the audio management computing module 206 determines that the distance between the third location of the user 220 and the information handling system 202 is greater than the second threshold (e.g., five meters), the audio management computing module 206 can adjust the power state of the speakers 214 and the microphone array 212 to an off-power state, at 334, as shown in FIG. 8. For example, when the user 220 is "out-of-range" of the speakers 214 and/or the microphone array 212, the audio management computing module 206 can adjust the power state of the speakers 214 and the microphone array 212 to the off-power state. In some examples, the second threshold can be customized by the user 220, or pre-defined (e.g., by a manufacturer of the information handling system 202).

In some examples, when the audio management computing module 206 determines that the distance between the third location of the user 220 and the information handling system 202 is greater than the second threshold (e.g., five meters), the audio management computing module 206 can "handover" the audio signal to the mobile computing device 204. That is, the audio management computing module 206 can switch from providing audio from the speakers 214 to providing audio through the mobile computing device 204 (e.g., speakers of the mobile computing device 204). In some examples, when the audio management computing module 206 determines that the distance between the third location of the user 220 and the information handling system 202 is greater than the second threshold (e.g., five meters), the audio management computing module 206 can i) transfer the audio signal to the mobile computing device 204 (e.g., the speakers of the mobile computing device 204 are in a powered-on state to generate sound) and ii) can adjust the power state of the speakers 214 and the microphone array 212 to an off-power state.

Figure 9:
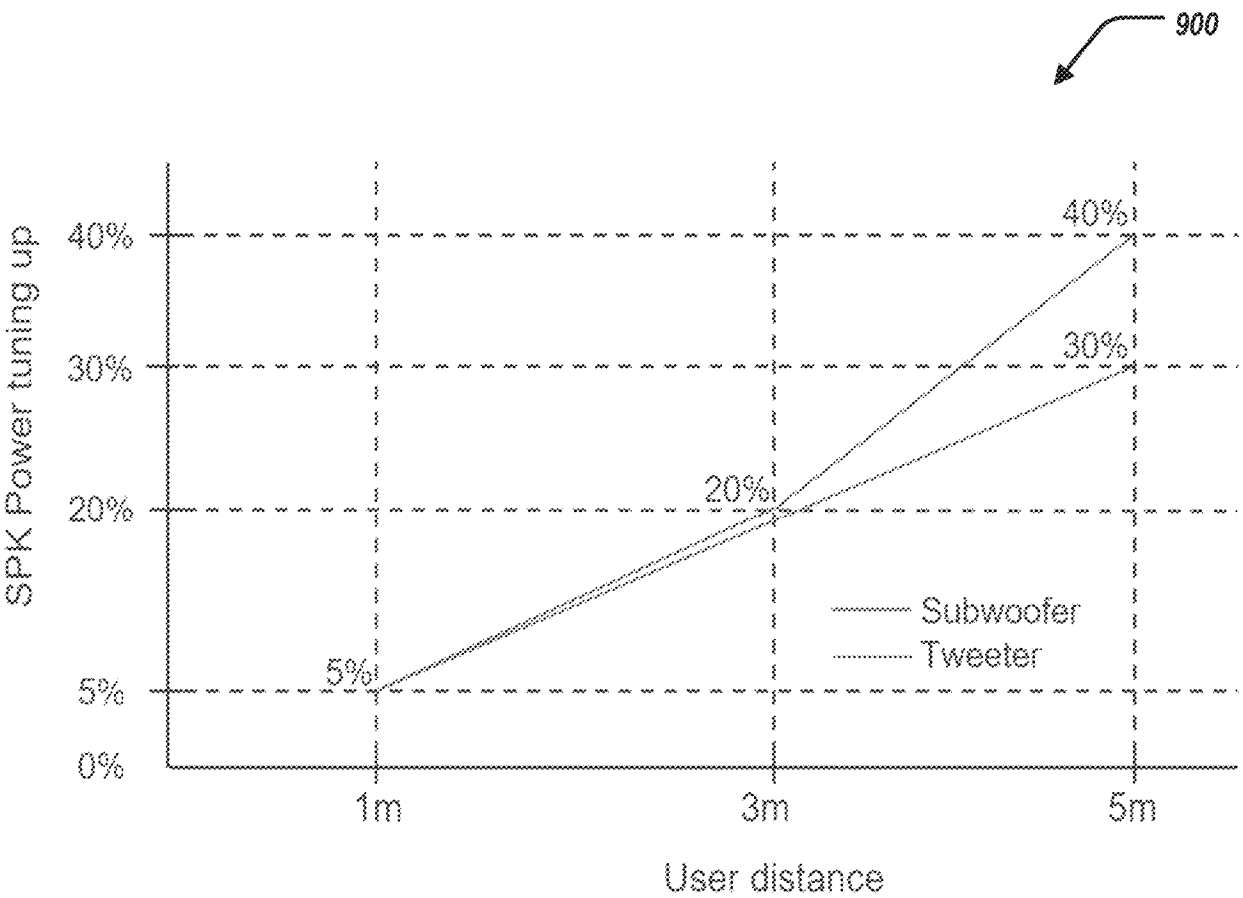
FIG. 9 illustrates a graph of an audio output power of the speaker array.

FIG. 9 illustrates a graph 900 of the audio output power of any of the speakers 214. Specifically, the graph 900 illustrates, for a speaker 214, the power of the speaker 214 (in terms of percentage increase) versus the distance of the user 220 from the information handling system 202. For example, for the user distance less than 1 meter (e.g., as shown in FIG. 5), the power of the speakers is the same as the settings provided by the information handling system 202 (initial settings). For the user distance between 1 meter and 3 meters (as shown in FIG. 6), the power of the speakers 214 are tuned up, with the power of the speakers 214 at the high frequency (e.g., tweeters) are increased at a slightly larger pace. For the user distance between 3 meters and 5 meters (as shown in FIG. 7), the power of the speakers 214 are further tuned up (increased), with the power of the speakers 214 at the high frequency (e.g., tweeters) are increased at a much larger pace. For the user distance greater than 5 meters (as shown in FIG. 8), the speakers 214 are in a power-off state.

In some examples, when the speakers 214 are in the second configuration, the power of the speakers 214 are greater than the power of the speakers 214 in the first configuration.

In some examples, when the speakers 214 are in the third configuration, the power of the speakers 214 are greater than the power of the speakers 214 in the second configuration.

In some examples, when the speakers 214 are in the fourth configuration, the power of the speakers 214 are greater than the power of the speakers 214 in the third configuration.

Figure 10:
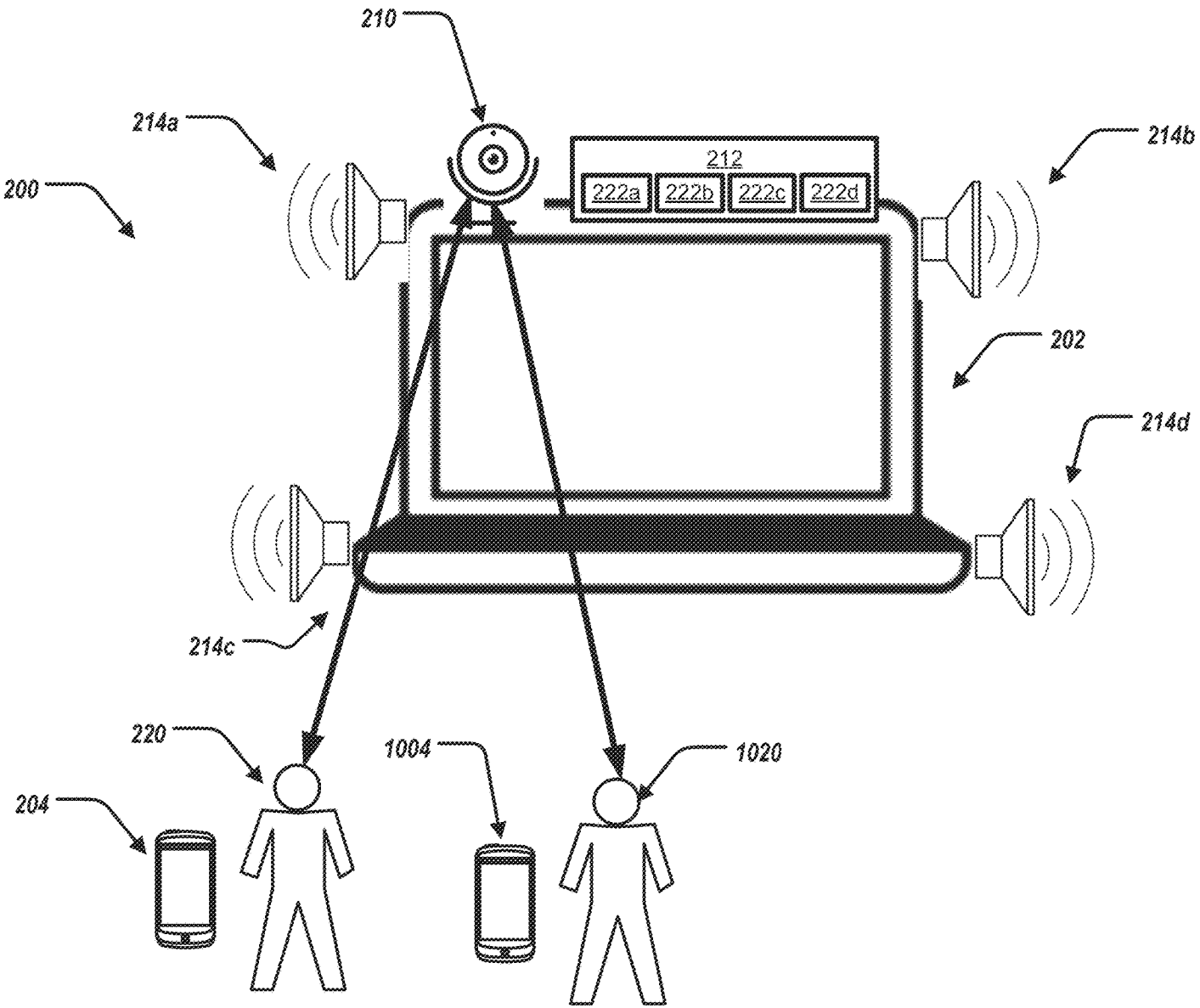
FIG. 10 illustrates a configuration of the information handling system with multiple users.

FIG. 10 illustrates the environment 200 including the user 220 and an additional user 1020. The additional user 1020 can be associated with an additional mobile computing device 1004. To that end, the camera module 210 can detect the presence of the user 220 and the additional user 1020, similar to that described above with respect to FIGS. 4 and 5. The distances of each of the users 220, 1020 can be determined by the location detection computing module 213, similar to that described above with respect to FIGS. 6-8. The audio management computing module 206, in response to the respective distances of the users 220, 1020, can calculate a fifth configuration of the speakers 214 based on the respective locations of the user 220, 1020. That is, the fifth configuration of the speakers 214—frequency of each speaker 214, channel of each speaker 214, and power (or volume level) of each speaker 214—is set (or configured) based on the locations of each of the users 220, 1020. In some examples, the fifth configuration of the speakers 214 is further based on the context of the users 220, 1020 with respect to the information handling system 202, and/or the context of the information handling system 202.

The audio management computing module 206 can further calculate a third configuration of the microphone array 212 based on the locations of the user 220, 1020. Specifically, the third configuration of the microphone array 212 can include selecting a first subset of the microphones 222—e.g., the microphones 222*a*, 222*b* that are closest to the user 220; and a second subset of the microphones 222—e.g., the microphones 222*c*, 222*d* that are closed the user 1020. The audio management computing module 206 can apply a beamforming algorithm to the first subset of microphones 222 for the user 220 (e.g., upon detection of speech from the user 220); and apply a beamforming algorithm to the second subset of microphones 222 for the user 1020 (e.g., upon detection of speech from the user 1020).

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A computer-implemented method of controlling audio of an information handling system, the method comprising:

identifying a first location of a user of the information handling system with respect to the information handling system;

calculating a first configuration of speakers and a first configuration of a microphone array of an information handling system based on the first location of the user, the first configuration of the speakers including a first frequency and a first power associated with a first speaker, and a second frequency and a second power associated with a second speaker, the first configuration of the microphone array including selecting a first subset of microphones of the microphone array to microphone beamform based on the first location of the user;

identifying a change in location of the user from the first location with respect to the information handling system, and in response:

determining whether the user is within a field of view of a camera of the information handling system;

in response to determining that the user is not within the field of view of the camera of the information handling system, determining a second location of a mobile computing device associated with the user with respect to the information handling system;

calculating a distance between the second location of the user and the information handling system;

calculating a second configuration of the speakers of the information handling system based on the second location of the user, the second configuration including the second frequency and a third power associated with the first speaker, and the first frequency and a fourth power associated with the second speaker;

calculating a second configuration of the microphone array based on the second location of the user, the second configuration of the microphone array including selecting a second subset of microphones of the microphone array to microphone beamform based on the second location of the user; and increasing a gain of the second subset of microphones of the microphone array based on the distance greater than a first threshold and less than a second threshold.

2. The computer-implemented method of claim 1, wherein in response to identifying the change in location of the user further comprises:

determining that the distance is greater than the second threshold; and in response to the distance being greater than the second threshold, adjusting a power state of the speakers and the microphone array to an off-power state.

3. The computer-implemented method of claim 1, further comprising:

determining that the user is within the field of view of the camera of the information handling system, and in response:

determining a third location of the user with respect to the information handling system;

calculating a third configuration of the speakers of the information handling system based on the third location of the user, the third configuration including the second frequency and a fifth power associated with the first speaker, and the first frequency and a sixth power associated with the second speaker.

4. The computer-implemented method of claim 1, wherein the third power of the first speaker is greater than the first power of the first speaker, and the fourth power of the second speaker is greater than the second power of the second speaker.

5. The computer-implemented method of claim 3, wherein the fifth power of the first speaker is greater than the first power of the first speaker and less than the third power of the first speaker; and the sixth power of the second speaker is greater than the second power of the second speaker and less than the fourth power of the second speaker.

6. The computer-implemented method of claim 1, wherein the second frequency is greater than the first frequency.

7. An information handling system comprising a processor having access to memory media storing instructions executable by the processor to perform operations comprising, comprising:

identifying a first location of a user of the information handling system with respect to the information handling system;

calculating a first configuration of speakers and a first configuration of a microphone array of an information handling system based on the first location of the user, the first configuration of the speakers including a first frequency and a first power associated with a first speaker, and a second frequency and a second power associated with a second speaker, the first configuration of the microphone array including selecting a first subset of microphones of the microphone array to microphone beamform based on the first location of the user;

identifying a change in location of the user from the first location with respect to the information handling system, and in response:

determining whether the user is within a field of view of a camera of the information handling system;

in response to determining that the user is not within the field of view of the camera of the information handling system, determining a second location of a mobile computing device associated with the user with respect to the information handling system;

calculating a distance between the second location of the user and the information handling system;

calculating a second configuration of the speakers of the information handling system based on the second location of the user, the second configuration including the second frequency and a third power associated with the first speaker, and the first frequency and a fourth power associated with the second speaker;

calculating a second configuration of the microphone array based on the second location of the user, the second configuration of the microphone array including selecting a second subset of microphones of the microphone array to microphone beamform based on the second location of the user; and increasing a gain of the second subset of microphones of the microphone array based on the distance greater than a first threshold and less than a second threshold.

8. The information handling system of claim 7, wherein in response to identifying the change in location of the user further comprises:

determining that the distance is greater than the second threshold; and in response to the distance being greater than the second threshold, adjusting a power state of the speakers and the microphone array to an off-power state.

9. The information handling system of claim 7, the operations further comprising:

determining that the user is within the field of view of the camera of the information handling system, and in response:

determining a third location of the user with respect to the information handling system;

calculating a third configuration of the speakers of the information handling system based on the third location of the user, the third configuration including the second frequency and a fifth power associated with the first speaker, and the first frequency and a sixth power associated with the second speaker.

10. The information handling system of claim 7, wherein the third power of the first speaker is greater than the first power of the first speaker, and the fourth power of the second speaker is greater than the second power of the second speaker.

11. The information handling system of claim 9, wherein the fifth power of the first speaker is greater than the first power of the first speaker and less than the third power of the first speaker; and the sixth power of the second speaker is greater than the second power of the second speaker and less than the fourth power of the second speaker.

12. The information handling system of claim 7, wherein the second frequency is greater than the first frequency.

13. A non-transitory computer-readable medium storing software comprising instructions executable by one or more computers which, upon such execution, cause the one or more computers to perform operations comprising:

identifying a first location of a user of the information handling system with respect to the information handling system;

calculating a first configuration of speakers and a first configuration of a microphone array of an information handling system based on the first location of the user, the first configuration of the speakers including a first frequency and a first power associated with a first speaker, and a second frequency and a second power associated with a second speaker, the first configuration of the microphone array including selecting a subset of microphones of the microphone array to microphone beamform based on the first location of the user;

identifying a change in location of the user from the first location with respect to the information handling system, and in response:

determining whether the user is within a field of view of a camera of the information handling system;

in response to determining that the user is not within the field of view of the camera of the information handling system, determining a second location of a mobile computing device associated with the user with respect to the information handling system;

calculating a distance between the second location of the user and the information handling system;

calculating a second configuration of the speakers of the information handling system based on the second location of the user, the second configuration including the second frequency and a third power associated with the first speaker, and the first frequency and a fourth power associated with the second speaker;

calculating a second configuration of the microphone array based on the second location of the user, the second configuration of the microphone array including selecting a second subset of microphones of the microphone array to microphone beamform based on the second location of the user; and increasing a gain of the second subset of microphones of the microphone array based on the distance greater than a first threshold and less than a second threshold.

14. The computer-readable medium of claim 13, wherein in response to identifying the change in location of the user further comprises:

determining, based on the comparing, that the distance is greater than the second threshold; and in response to the distance being greater than the second threshold, adjusting a power state of the speakers and the microphone array to an off-power state.

* * * * *